US006751804B1

(12) United States Patent
Warner et al.

(10) Patent No.: US 6,751,804 B1
(45) Date of Patent: Jun. 22, 2004

(54) TROUSERS WITH ADJUSTABLE LOCATION KNEE PADS

(76) Inventors: Robert J. Warner, 312 Hickory Grove Dr., Thousand Oaks, CA (US) 91320; Margaret A. Warner, 312 Hickory Grove Dr., Thousand Oaks, CA (US) 91320

( * ) Notice: Subject to any disclaimer, the term of this patent is extended or adjusted under 35 U.S.C. 154(b) by 0 days.

(21) Appl. No.: 10/657,004

(22) Filed: Sep. 8, 2003

(51) Int. Cl.[7] ..... A41D 13/00
(52) U.S. Cl. ..... 2/23
(58) Field of Search ..... 2/22–24, 62, 79, 2/227, 69, 242, 267, 268, 247–253, 256, 257, 455, 404, 407, 911; 128/881, 882; 602/23, 26, 61, 62, 63

(56) References Cited

U.S. PATENT DOCUMENTS 4,424,809 A * 1/1984 Yovankin ..... 602/62
5,105,473 A * 4/1992 Valtakari ..... 2/461
5,161,257 A * 11/1992 Arensdorf et al. ..... 2/465
5,377,693 A * 1/1995 Loper et al. ..... 128/845
5,466,251 A * 11/1995 Brunson et al. ..... 607/112
5,539,926 A * 7/1996 Mantos ..... 2/23
5,717,997 A * 2/1998 Garcia ..... 2/23
5,729,832 A * 3/1998 Grilliot et al. ..... 2/23

* cited by examiner

*Primary Examiner*—Tejash Patel
(74) *Attorney, Agent, or Firm*—Allan M. Shapiro

(57) ABSTRACT

A series of vertically overlapping pockets is attached to the fabric of the trousers adjacent the knee. The open ends of pairs of pockets face each other and a foam or other resilient kneepad is partially inserted through the open ends into a selected pair of facing pockets. Using different pairs of facing pockets selectively positions the kneepads on the trousers at selected vertical locations. The panels forming the pockets may be positioned on the inside or on the outside of the trousers adjacent the knee, and may be preassembled to form a separate structure for attachment to the trousers.

20 Claims, 3 Drawing Sheets

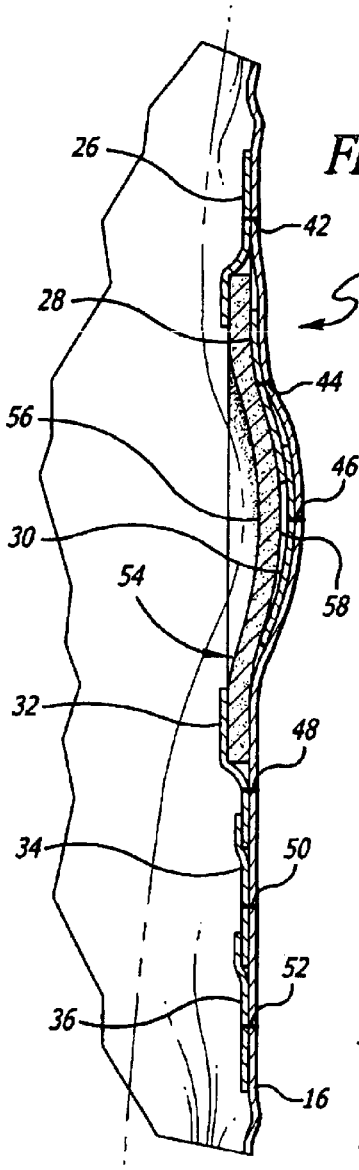
FIG. 4
FIG. 3
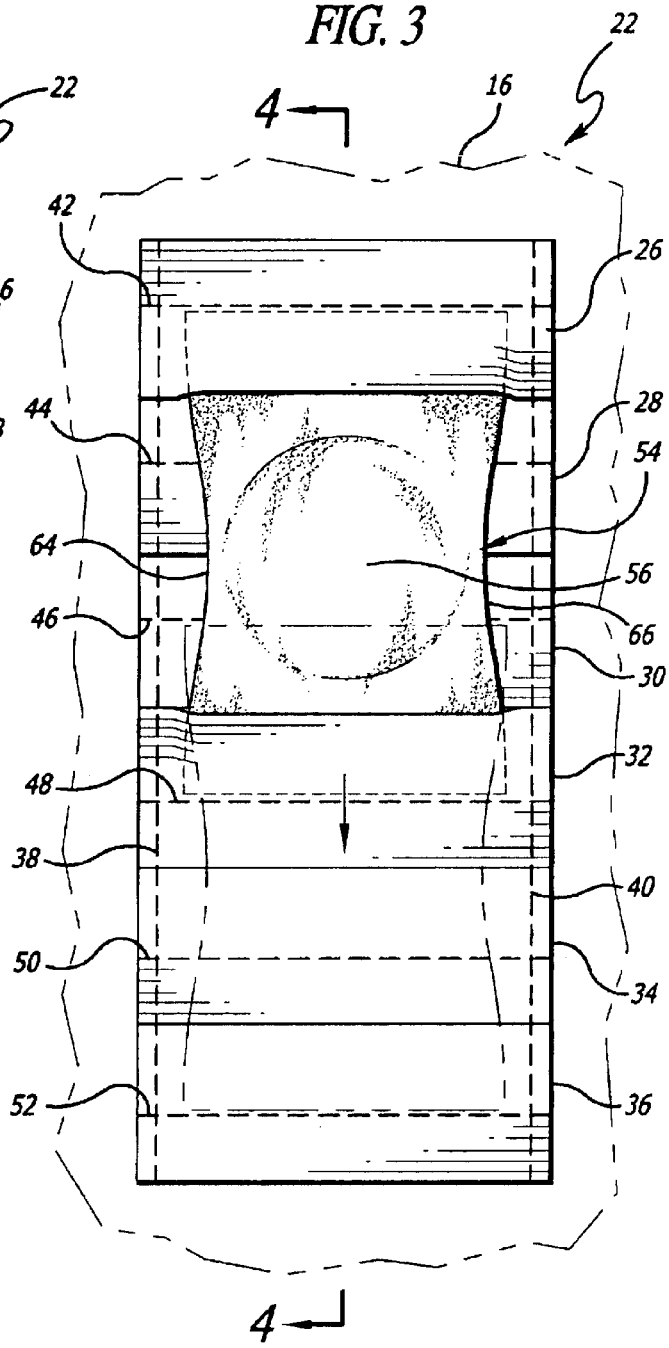

TROUSERS WITH ADJUSTABLE LOCATION KNEE PADS

FIELD OF THE INVENTION

The trousers have knee pads therein and are particularly useful for those who have work or who have a hobby which requires them to kneel. The knee pads are adjustable in position with respect to the trousers.

BACKGROUND OF THE INVENTION

Many persons must kneel in performance of their work. For example, carpet installers must kneel when attaching nail strips around the periphery of the area to be carpeted. They must also kneel when the carpet sections are joined and when the carpet is stretched. This kneeling is hard on the knees unless they are protected. Other occupations also require kneeling. For example, plumbers must kneel to do plumbing work near the floor. Carpenters must kneel to do carpentry at low levels. This is particularly true in finish carpentry for the installation of baseboards, trim and cabinets.

In addition, there are non-work situations where kneeling is helpful. With any long term effort near the ground, kneeling is preferable to bending. Thus, garden work often requires kneeling for attention to plants or planting. There are pads which can be carried along and put in position for kneeling. There are foam kneepads which can be strapped around the leg so that they are presumably in position when the user wants to kneel. However, such kneepads are inconvenient, or do not remain in position. Thus, there is a need for structure which properly positions the kneepad and holds it in place.

SUMMARY OF THE INVENTION

In order to aid in the understanding of this invention, it can be stated in essentially summary form that it is directed to a kneepad structure which is configured to be permanently attached to the interior or exterior of the trouser leg. The kneepad structure comprises multiple panels and combinations of panels which permit selectable positioning of the kneepad.

It is thus a purpose and advantage of this invention to provide a structure which can be attached to the trouser leg, either inside or outside, which permits the selectable positioning of a soft knee pad.

It is another purpose and advantage of this invention to provide trousers which have in association therewith a knee pad structure which includes selectable positioning of a soft knee pad, such as a foam knee pad.

It is another purpose and advantage of this invention to provide a structure which has a plurality of spaced and facing pockets and a foam knee pad, with the pockets and knee pad being configured so that the knee pad can be inserted into associated pairs of pockets to be releaseably retained therein.

The features of this invention which are believed to be novel are set forth with particularity in the appended claims. The present invention, both as to its organization and manner of operation, together with further objects and advantages thereof, may be best understood by reference to the following description, taken in conjunction with the accompanying drawings.

BRIEF DESCRIPTION OF THE DRAWINGS

FIG. 3 is a front elevational view of the knee pad structure, with a knee pad placed in a selected position.

FIG. 4 is a section taken generally along line 4—4 of FIG. 3.

DESCRIPTION OF THE PREFERRED EMBODIMENTS

Figure 1:
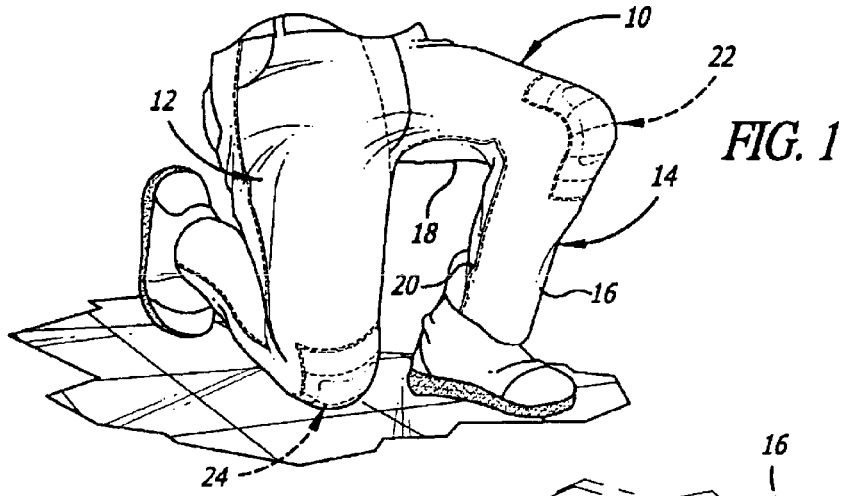
FIG. 1 is a perspective view of a man wearing a pair of trousers having associated therewith the adjustable location knee pad structure of this invention, with parts broken away.

FIG. 1 shows a pair of trousers 10 positioned as if they would be on a wearer who is kneeling on his right knee. The trousers 10 have a right leg 12 and a left leg 14. In conventional trousers the legs are made up of front and back panels. The front panel 16 and back panel 18 of the left trouser leg 14 are specifically identified. In the finished trousers they are secured together by an inseam 20 and a conventional outseam. The trousers are made up of a suitable fabric for trousers in which the person is going to be kneeling, such as chino or denim.

Attached to the inside of each front panel is a knee pad assembly. The knee pad assembly 22 is shown in the left leg 14 in FIG. 1. A similar knee pad assembly 24 can be installed on the inside of the front panel of the right leg 12, as also seen in FIG. 1. The knee pad assemblies are identical, and the knee pad assembly 22 will be described in detail in FIGS. 2, 3 and 4.

Figure 2:
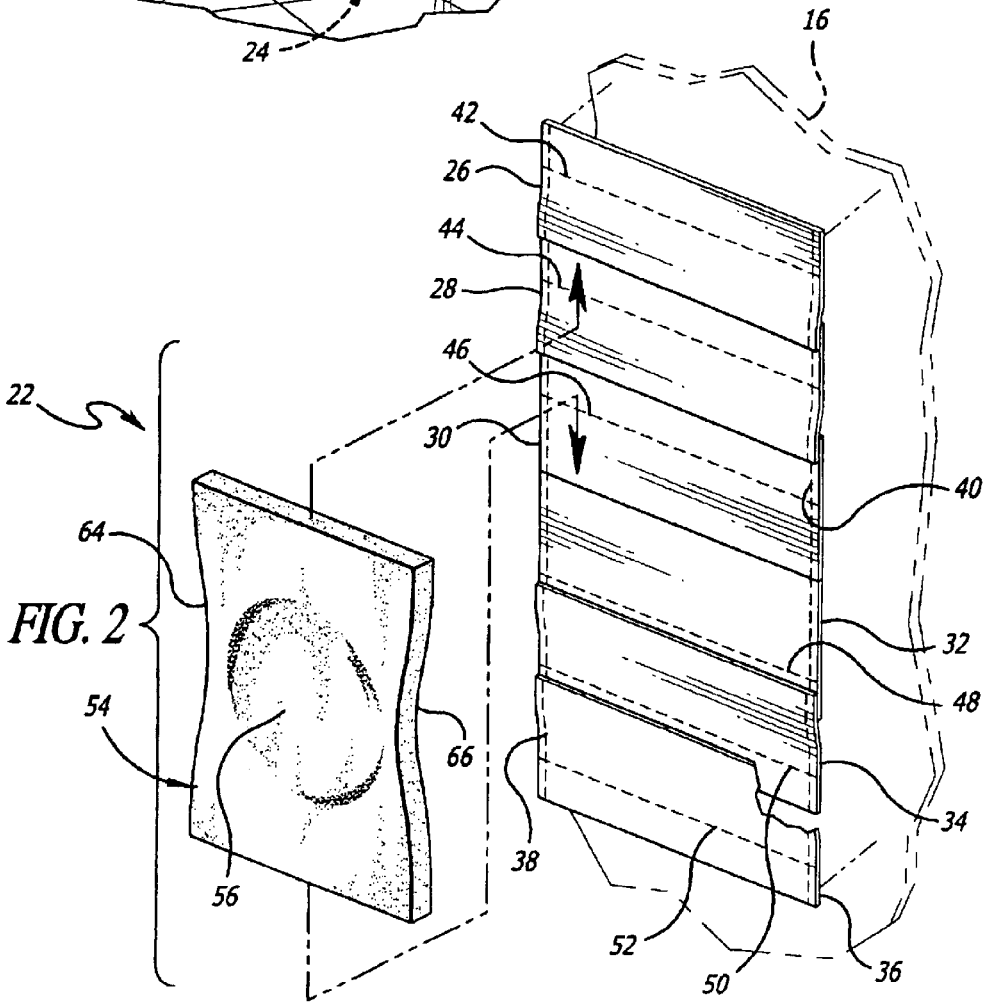
FIG. 2 is an exploded perspective view of the knee pad structure.

The knee pad assembly 22 is formed of six panels 26, 28, 30, 32, 34 and 36. These panels are each of flexible material, such as cloth, and they are secured to the interior of the trouser leg's front panel 16, as shown in FIGS. 2, 3 and 4. The upper panels 26, 28 and 30 are sewn upon the interior of the front panel as downward-facing pockets. The lower panels 32, 34 and 36 are arranged in line with the upper panels and are sewn in as upward-facing pockets. They are secured to the front panel by left and right stitch lines 38 and 40, which are seen in FIGS. 2 and 3. Each pocket panel is sewn across to form an inside termination or bottom of the pocket. In the case of panels 26, 28 and 30, these pockets are facing down so that the upward end of those panels form the "bottom" of the pockets. Stitch lines 42, 44 and 46 respectively close the pockets formed by the first, second and third panels 26, 28 and 30, respectively. These stitch lines form downwardly open pockets. It is also to be noted that the panels slightly overlap each other so that at the open edge the panel 28 overlaps panel 30 and panel 26 overlaps panel 28. The stitch lines are just beyond the free edges of the panel where the pockets are formed. Stitch lines 48, 50 and 52 close the bottoms of the pockets formed by panels 32, 34, and 36, respectively. These panels thus form upwardly open pockets. These pockets are well-seen in FIGS. 3 and 4. The overlap is best seen in FIGS. 2 and 4. The distance between the open edges of the first panel and fourth panel is equal to the distance between the open edges of the second panel and fifth panel and is also equal to the distance between the open edges of the third panel and the sixth panel. Since each of the pockets has the same depth, then the distances between the bottoms of the corresponding pockets is also the same.

Knee pad 54 is substantially rectangular and is of substantially uniform thickness. It is made of resilient material such as synthetic polymer composition foam, such as polyurethane foam. The foam should be resilient enough to be soft under the knees but not so soft that it completely crushes under the weight of the knee. The thickness of the knee pad can be related to the firmness thereof. While the knee pad is of substantially uniform thickness, it preferably has a dome therein. The concave side of the dome is shown at 56 in FIG. 2, while the convex side is shown at 58 in FIG. 3. The length of the knee pad 54 from its top edge 60 to its bottom edge 62 is slightly less than the distance from the bottom 42 of the first pocket to the bottom 48 of the fourth pocket. As seen in FIGS. 3 and 4, the knee pad 54 can be slipped into the first and fourth pockets and retained therein. In order to position the knee pad in accordance with the desires of the particular user, the knee pad 54 can be alternatively positioned in the second and fifth pockets or the third and sixth pockets. As illustrated, the distance between the bottoms of the second and fifth pockets, and between the bottoms of the third and sixth pockets, is effectively he same distance as between the bottoms of the first and fourth pockets. Thus, there are three locations, up and down the trouser leg, in which the knee pad can be positioned at the choice of the user. As can be seen in FIG. 1, the structure bends at the knee pad. In order to facilitate the bending of the knee pad 54 at the right place, it is configured with curved-in sides 64 and 66 at about the middle of the knee pad 54 so as to reduce the amount of bending force required.

The trousers 10 with the adjustable location knee pad structure 22 shown in FIGS. 1–4 is clearly more easily installed before the trousers are assembled. The panels 26–36 are better installed when the front panel 16 of the trouser leg is in the flat condition and is accessible from the inside. Thus, the panels are preferably installed before the trousers are sewn up.

Figure 5:
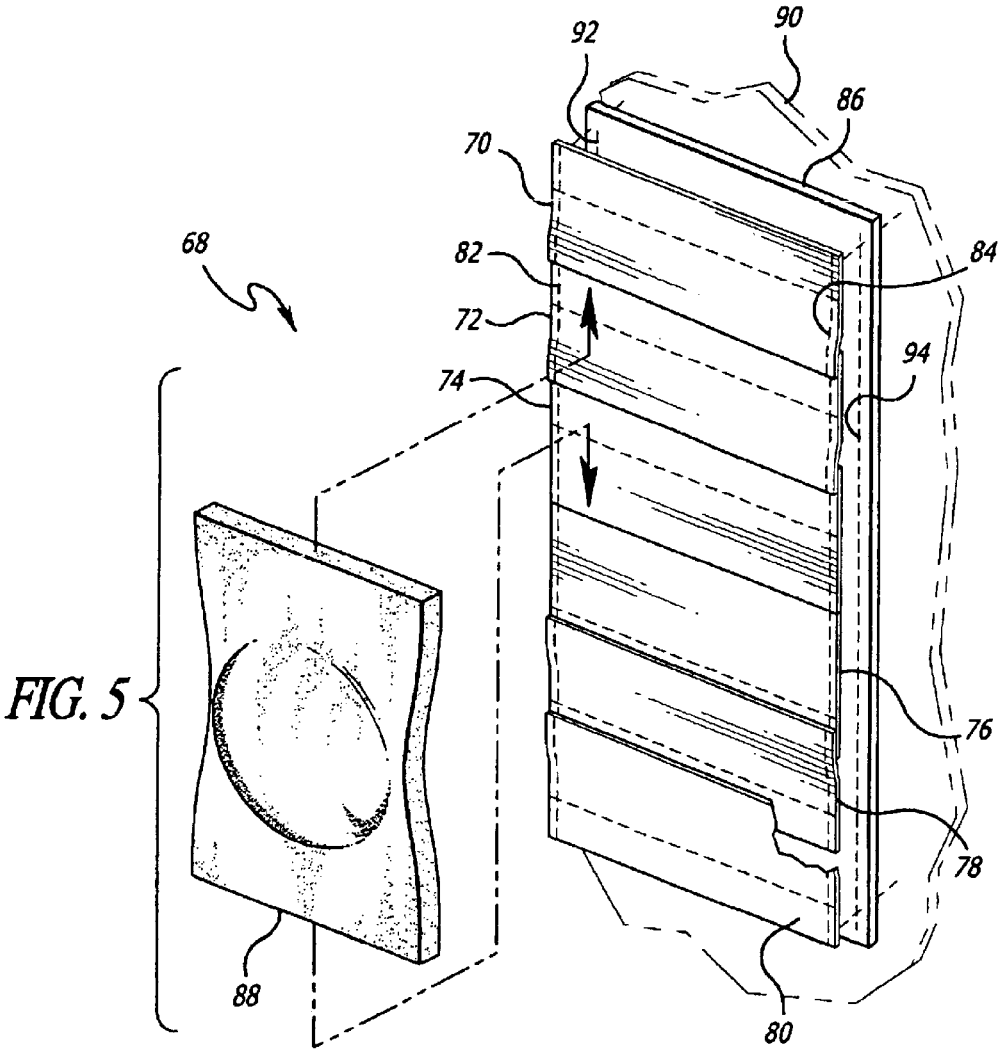
FIG. 5 is an exploded perspective view showing the knee pad structure preassembled for attachment to the outside of the trouser leg.

FIG. 5 teaches a similar knee pad assembly 68 which is more easily secured to the trousers after the trousers are sewn up. The knee pad assembly 68 is thus a preassembled structure which can be sewn onto the interior or the exterior of the trouser legs after the trousers are assembled. In the same manner as the knee pad assembly 22, in the knee pad assembly 68 the three panels 70, 72 and 74 are positioned so that they overlap each other in the downward direction to form pockets having downwardly facing open edges. The lower panels 76, 78 and 80 are overlapped and positioned and have upwardly open pockets. The panels are attached by seam lines 82 and 84 to backing layer 86. The backing layer 86 is a fabric layer which holds the panels in position. The backing layer is slightly wider and slightly longer than the assembly structure of panels 70–80. The assembly is thus ready to receive the knee pad 88, which is the same as knee pad 54. The knee pad 88 is sized so that it can be inserted into the first and fourth pockets, into the second and fifth pockets or the third and sixth pockets, similarly to the knee pad assembly structure 22 shown in FIGS. 1–4.

The knee pad assembly 68 is ready to be installed on the exterior of the trousers at the knee. Fabric panel 90 represents the front of the trouser leg at the knee. When the user is ready he can attach the knee pad assembly to the exterior surface. This is accomplished by sewing the backing layer 86 to the trouser panel along seam lines 92 and 94. In this way, the knee pad 88 can be attached to the exterior of trousers which are already sewn up. The backing layer 86 permits the knee pad assembly to be merchandised separately from the trousers and sewn on after the completion of trouser assembly. However, it should be noted that the preassembled structure 68 can be sewn onto the interior panel surface of the trousers, if desired.

This invention has been described in its presently contemplated best modes and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A knee pad assembly comprising:

a knee pad assembly for attachment to trousers adjacent the knee position thereon, said knee pad assembly comprising a first plurality of panels and a second plurality of panels, each of said first and second plurality of panels having a free open edge as first and second closed side edges and a closed bottom edge to define a pocket, said first plurality of panels having their free edges facing said second plurality of panels and said second plurality of panels having their free edges facing said first plurality of panels; and a pad, said pad being sized to engage under a selected one of said first plurality of panels and engage under one of said second plurality of panels so that said knee pad can be selectively positioned by engaging under a selected one of said first plurality of panels.

2. The knee pad assembly of claim 1 wherein the distance between the open edge of one of said first plurality of panels and the open edge of one of said second plurality of panels is the same as the distance between another one of said first plurality of panels and another one of said second plurality of panels.

3. The knee pad assembly of claim 2 wherein there are first, second and third panels in said first group of panels and there are fourth, fifth and sixth panels in said second group of panels and the distance between the open edge of the first panel and the open edge of said fourth panel is the same as the distance between the open edge of said second panel and said open edge of said fifth panel and is the same as the distance between the open edge of said third panel and said open edge of said sixth panel.

4. The knee pad assembly of claim 3 wherein said pad has a concave face and a convex face and said pad is positioned so that its concave face is toward the user's knee.

5. The knee pad assembly of claim 3 wherein said assembly is positioned on the inside of a trouser leg.

6. The knee pad assembly of claim 3 wherein said assembly is positioned on the outside of a trouser leg.

7. The knee pad assembly of claim 3 wherein said panels are secured to a backing layer and said backing layer is for securement to the trouser leg.

8. A knee pad assembly comprising:

a first plurality of panels and a second plurality of panels, said panels being secured together in alignment with each other, said panels being closed on their left and right edges and bottom edges to form a first plurality of pockets and a second plurality of pockets, each having an open edge, said pockets being secured with respect to each other so that said open edges of said first plurality of pockets face the open edges of said second plurality of pockets to form a pocket assembly; and a knee pad, said knee pad being sized to engage in a selected one of said first plurality of pockets and in a corresponding one of said second plurality of pockets so that said knee pad can be selectively positioned with respect to said pocket assembly.

9. The knee pad assembly of claim 8 wherein each of said second plurality of pockets is equidistant from a corresponding one of said first plurality of pockets.

10. The knee pad assembly of claim 8 wherein the distance from one of said first plurality of pockets to one of said second plurality of pockets is the same as the distance from another one of said first plurality of pockets to another one of said second plurality of pockets so that said knee pad can be engaged in one of said plurality of pockets and one of said second plurality of pockets to selectively position said pad in said pocket assembly.

11. The knee pad assembly of claim 10 wherein said pad is a polymer foam pad, said polymer foam pad being configured to bend substantially on its center line.

12. The knee pad assembly of claim 11 wherein said knee pad has a concave face for positioning toward the user's knee and a convex face for positioning away from the user's knee.

13. The knee pad assembly of claim 10 wherein said knee pad has sides and said sides are curved to encourage bending across the centerline of the knee pad and said knee pad has a concave dome on its face for positioning toward the knee.

14. A knee pad assembly for attachment to the knee areas of the user's trousers, said knee pad assembly comprising a pocket assembly, said pocket assembly comprising a plurality of overlapping panels, said panels having a left edge and a right edge, said panels being stitched together on stitch lines adjacent said left edge and adjacent said right edge, each of said panels being stitched across from said left edge to said right edge to define a pocket, a first plurality of said panels having said pockets facing toward said second plurality of panels and said second plurality of panels having its pockets facing said first plurality of panels; and a knee pad, said knee pad having sides and having a distance between said sides less than said distance between said stitch lines so that said knee pad can be inserted into a selected one of said pockets defined by said first plurality of panels and into a corresponding one of said pockets formed by said second plurality of panels so that said knee pad can be selectively positioned with respect to said panels.

15. The knee pad assembly of claim 14 wherein said panels are directly sewn on said stitch lines to the front panel of the wearer's trousers.

16. The knee pad assembly of claim 14 wherein there is a backing layer to which said panels are attached by said stitch lines and said backing layer is for attachment to the knee area of the user's trousers.

17. The knee pad assembly of claim 14 wherein said pad has a concave face and a convex face and said pad is positioned so that its concave face is toward the user's knee.

18. The knee pad assembly of claim 14 wherein said pad is a polymer foam pad, said polymer foam pad being configured to bend substantially on its center line.

19. The knee pad assembly of claim 18 wherein said knee pad has a concave face for positioning toward the user's knee and a convex face for positioning away from the user's knee.

20. The knee pad assembly of claim 14 wherein said knee pad has sides and said sides are curved to encourage bending across the centerline of the knee pad and said knee pad has a concave dome on its face for positioning toward the knee.

* * * * *